US006435608B1

(12) United States Patent
Floyd, Jr.

(10) Patent No.: US 6,435,608 B1
(45) Date of Patent: Aug. 20, 2002

(54) SEATING DEVICE

(75) Inventor: Franklin B. Floyd, Jr., Shaker Heights, OH (US)

(73) Assignee: Reliable Construction Heaters, Incorporated, Cleveland, OH (US)

( * ) Notice: Subject to any disclaimer, the term of this patent is extended or adjusted under 35 U.S.C. 154(b) by 0 days.

(21) Appl. No.: 09/716,007

(22) Filed: Nov. 17, 2000

Related U.S. Application Data

(60) Provisional application No. 60/166,607, filed on Nov. 19, 1999.

(51) Int. Cl.[7] ..... A47C 7/72; A47C 31/00

(52) U.S. Cl. ..... 297/180.13; 297/217.1; 297/217.7; 297/180.12

(58) Field of Search ..... 297/180.11, 180.12, 297/180.13, 217.1, 217.3, 217.7; 219/217, 218

(56) References Cited

U.S. PATENT DOCUMENTS 390,154 A * 9/1888 Beach ..... 297/180.13 X
3,745,305 A * 7/1973 Reed et al. ..... 297/180.13 X
3,948,246 A 4/1976 Jenkins
4,134,615 A 1/1979 Jenkins
4,225,774 A 9/1980 Taberman
4,226,363 A 10/1980 Sheldon
4,307,701 A 12/1981 Balon et al.
4,509,792 A 4/1985 Wang
4,676,223 A 6/1987 Peterson
5,404,865 A 4/1995 Huls

* cited by examiner

*Primary Examiner*—Anthony D. Barfield
(74) *Attorney, Agent, or Firm*—Calfee Halter & Griswold LLP

(57) ABSTRACT

A seating device having a heat source fluidly connected to a substantially hollow bench which defines an interior space, a substantially hollow deck extending outwardly from the footwall of the bench, perforations in the frontal wall of the base to exhaust pressurized heated air from the interior space of the bench into the deck, and perforations in the top surface of the deck to exhaust pressurized heated air from the deck and into the atmosphere. The pressurized heated air warms the entire outer surface of the bench and the deck. The pressurized heated air exhausting from the perforations in the top surface of the deck warms the entire region in front of the bench. The seating device provides heat to the entire body of a person sitting on its bench or standing on its deck.

14 Claims, 4 Drawing Sheets

SEATING DEVICE

PRIORITY CLAIM

This application claims the benefit of U.S. provisional patent application No. 60/166,607 filed on Nov. 19, 1999, the entirety of which is hereby incorporated by reference.

BACKGROUND OF INVENTION

The present invention relates to a device designed to warm persons participating in cold climate activities, and in particular to a seating device useful in warming participants or observers in cold-weather outdoor athletic events, such as football games.

FIELD OF THE INVENTION

The desire to provide a heat source for those observers or participants in athletic events who are not actively engaged in the athletic contest—coaches, substitute players, the offensive or defensive squads that are alternatively on the sideline or on the playing field, etc.—has led to the development and use of various personnel warming devices. Known warmers include torpedo heaters and other space heaters designed to blow hot air into a general area, heated benches for seating, and heated bench-like structures that can be used as seats or that otherwise serve as radiant sources of heat. The present invention represents an improvement to known heated benches and bench-like structures, as it is a more effective and comfortable means of warming the entire body of a person who is required or desires to sit or stand for long periods of time in a cold environment.

Known heated benches have not been designed to be effective and convenient total body warmers. For example, U.S. Pat. No. 3,948,246 to Jenkins discloses a bench wherein heated air under pressure is moved from a heating source through a conduit and into a mostly hollow bench structure. The Jenkins bench is perforated in multiple locations, thus providing necessary outlets for exhausting the pressurized air, and also creating streams of heated air blowing onto whoever is sitting on the bench. However, neither Jenkins nor any other known bench is effectively able to route this exhausted air so that it envelopes the entire body of the sitter(s) without the use of flexible hoses extending from the bench. The known benches are only effective when sat upon, and even then their effectiveness is limited to warming only the backside of the sitters. So in addition to only heating one side of the body, these benches also essentially deprive a person of the option of standing if that person wishes to experience any warmth at all.

In addition to the shortcomings discussed above, known heated benches do a particularly poor job of warming a person's feet. Jenkins provides for a compartment at the back of the bench into which the feet may be inserted, and U.S. Pat. No. 4,134,615, also to Jenkins, provides a bench that requires a person pull his lower legs and feet back into a compartment located in the front of the bench. In the first scenario, a person cannot warm his feet while simultaneously warming the rest of his body, because foot warming requires that the person stand behind the bench. In the second scenario, a person must sit uncomfortably to warm his feet.

Cylindrical bench-like structures, like that disclosed in U.S. Pat. No. 4,676,223 to Huls, have also been used as heat sources for participants at outdoor athletic events. The Huls device operates on many of the same basic principles as do the heated benches, but lacks the advantage of providing a back support for anyone wishing to sit upon the device. This device has been equipped with perforations for exhausting hot air at regular intervals along the length and circumference of the device, however, making standing near the device more of an option than it is with a heated bench. But the person standing near the device will not be fully enveloped in heated air, thereby leaving the side of his or her body facing away from the device exposed to the cold. Another disadvantage is that one cannot sit on the device and simultaneously warm his feet. Foot warming requires that the person face the cylindrical heater, standing with his toes beneath the drum.

Therefore, it is an objective of this invention to provide an efficient and effective heating system for warming the entire body of a person required or desiring to sit or stand for extended periods in a cold environment.

Another objective of the present invention is to provide an improved heating device which effectively warms the entire body, particularly including the feet, of persons finding themselves in a cold environment for extended periods, and provides those persons with the option of enjoying the warmth of the device while either sitting or standing.

SUMMARY OF THE INVENTION

According to one embodiment, the invention provides a seating device or a personnel warming system having an improved heated bench in combination with a heated deck which extends from a base of the footwall of the bench. A person may either sit on the bench with his feet resting on the deck in front of him, or he may stand on the deck itself. In either case, the invention effectively provides heat to the person's entire body, especially including the feet.

The bench is a substantially hollow structure that is warmed by heated air that is forced into an interior space defined by the bench. The entire outer surface of the bench is warmed by this process. The heated pressurized air is exhausted from the interior space of the bench and into a substantially hollow deck which extends outwardly from the base of the footwall of the bench. The deck has perforations in its top surface through which the heated, pressurized air is exhausted from the bench.

The bench configuration described above takes maximum advantage of the hot air that is exhausted from the heating system, creating a zone of hot air directly in front of the bench and above its deck that is sufficiently large enough to heat the front side of a person sitting on the bench. While sitting on the bench, a person's feet would be resting comfortably on the heated deck in front of him, keeping his feet warm and placing his lower legs in the path of the exhausted hot air. Moreover, the front side of the person's upper torso would also be in the zone of heated air.

The present invention also provides a person with the option of standing on the deck and still experiencing full body warmth. The zone of heated air originating from the perforations in the top surface of the deck extends high enough to fully envelope a person that is standing on the deck. The deck is an especially effective heating source when the person standing on it is wearing a parka or other long overgarment that is open at its bottom. In this situation, the hot air rising from the deck fills the interior space defined by the garment worn by the person standing over the exhaust. In the case of a parka worn in conjunction with the use of the present invention, the garment will retain its designed shape and the hot air exhausted from the deck is essentially trapped within the garment, providing additional warmth for the wearer. As the use of parkas is common among football teams, this is a significant advantage.

Other objects and advantages of the present invention will be apparent from the drawings and detailed discussions presented below.

DETAILED DESCRIPTION OF THE INVENTION

Figure 1A:
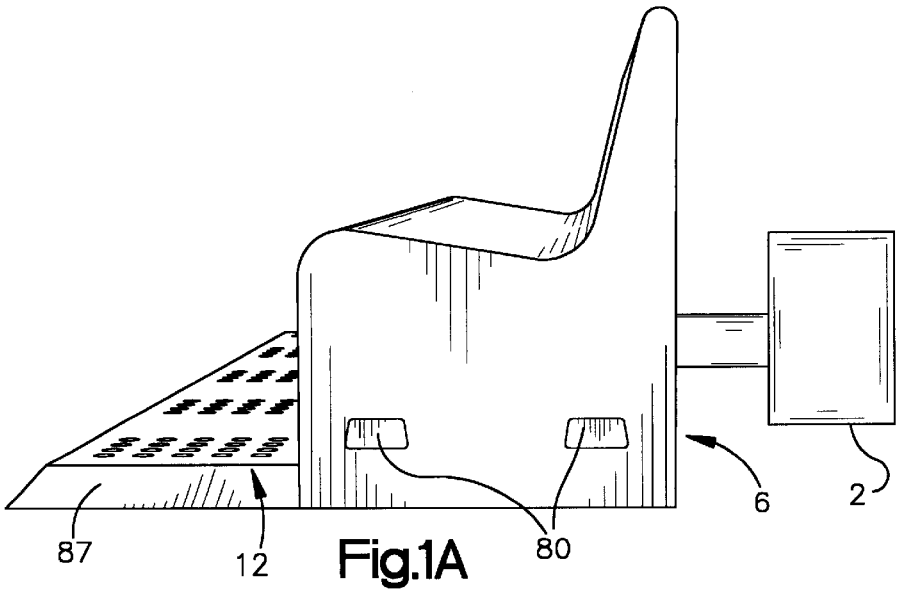
FIG. 1A is a perspective side view of the device of the present invention.
Figure 1B:
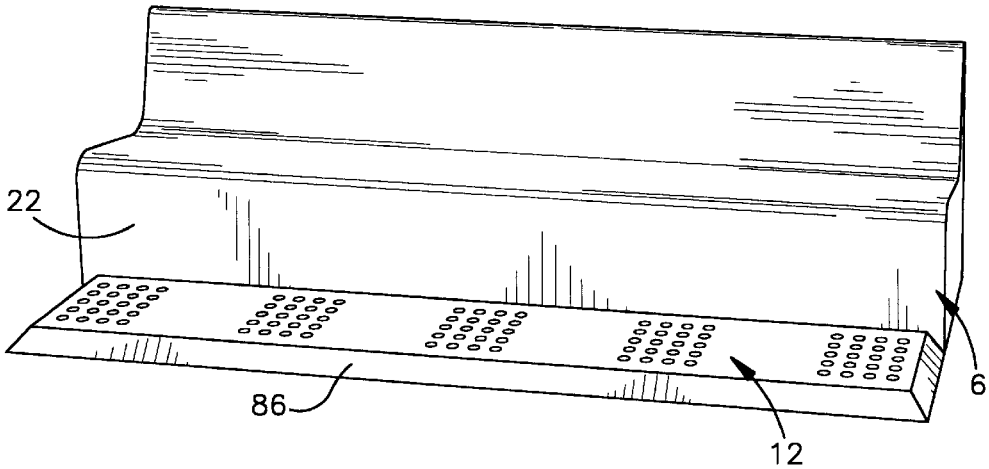
FIG. 1B is a perspective front view of the device of the present invention.
Figure 1C:
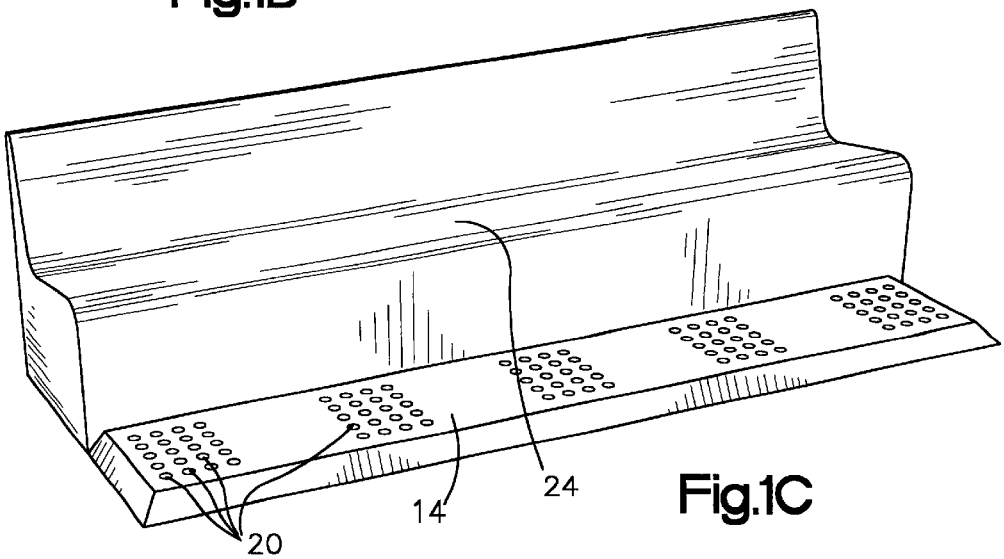
FIG. 1C is a perspective top view of the device of the present invention.
Figure 1D:
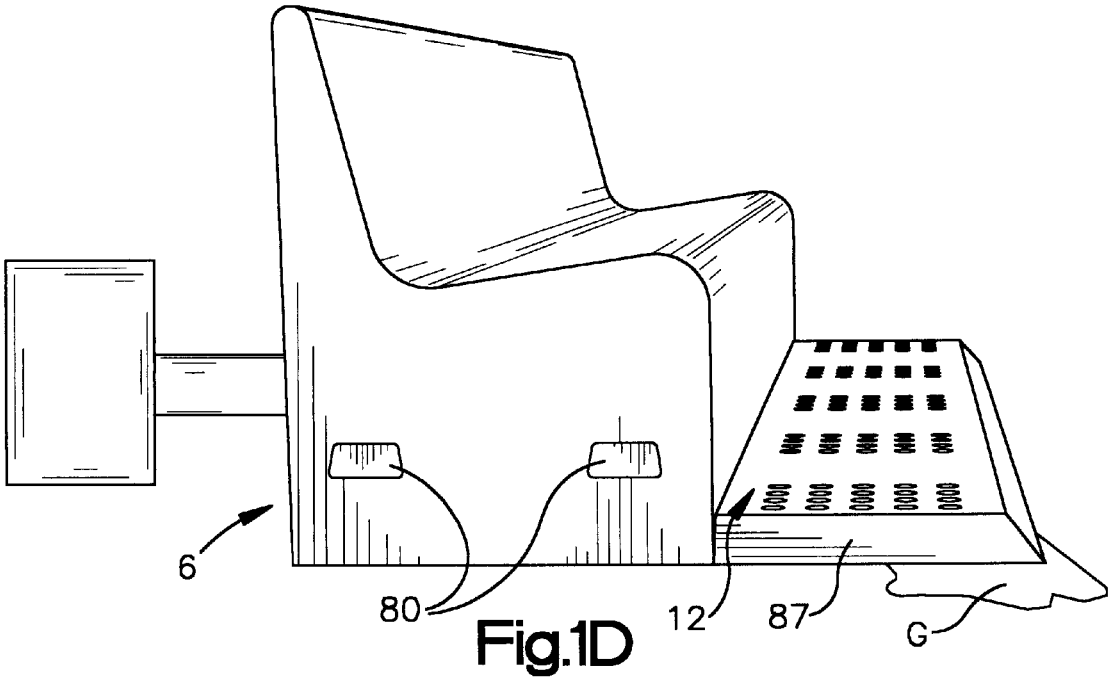
FIG. 1D is a perspective side view of the device of the present invention, illustrating the opposing side view of the device as that illustrated in FIG. 1A.

Referring to FIGS. 1A–1E, the inventive heated bench/deck combination is a seating device or a personnel warming system comprised of a bench 6 defining an interior space 8 bordered by the internal surface 11 of the bench and a substantially hollow deck 12, which when the invention is in operation, extends outwardly from a base 9 of the front wall portion or footwall 22 of the bench. The footwall 22 is defined herein as the substantially vertical portion at the front of the bench, against which the back of the lower legs of a person sitting on the bench would rest. The footwall 22 runs in a substantially vertical direction from the seating surface 24 of the bench to at least to the top surface 14 the deck, and possibly to the base of the bench, depending on the embodiment of the invention. The seating surface 24 of the bench is defined herein as the substantially horizontal portion of the bench against which generally the buttocks and upper legs of a sitting person would rest.

The interior space 8 of the bench is designed to receive heated pressurized air. This air is produced by a heat source 2. The heat source 2 may be located within the interior space 8 of the bench or it may be external to the bench, as illustrated. Where the heat source 2 is external to the bench, the heated, pressurized air is forced into the interior space 8 of the bench through an inlet conduit 4 that is fluidly connected to the heat source 2 and the bench 6 in the direction of the illustrated arrow. The heat source 2 can be any hot air generating device including, but not limited to, combustion heaters or electric resistance heaters. The heat source 2 may or may not be self-contained. It is preferred that the heat source 2 be a combustion heater fueled by natural gas.

Figure 1E:
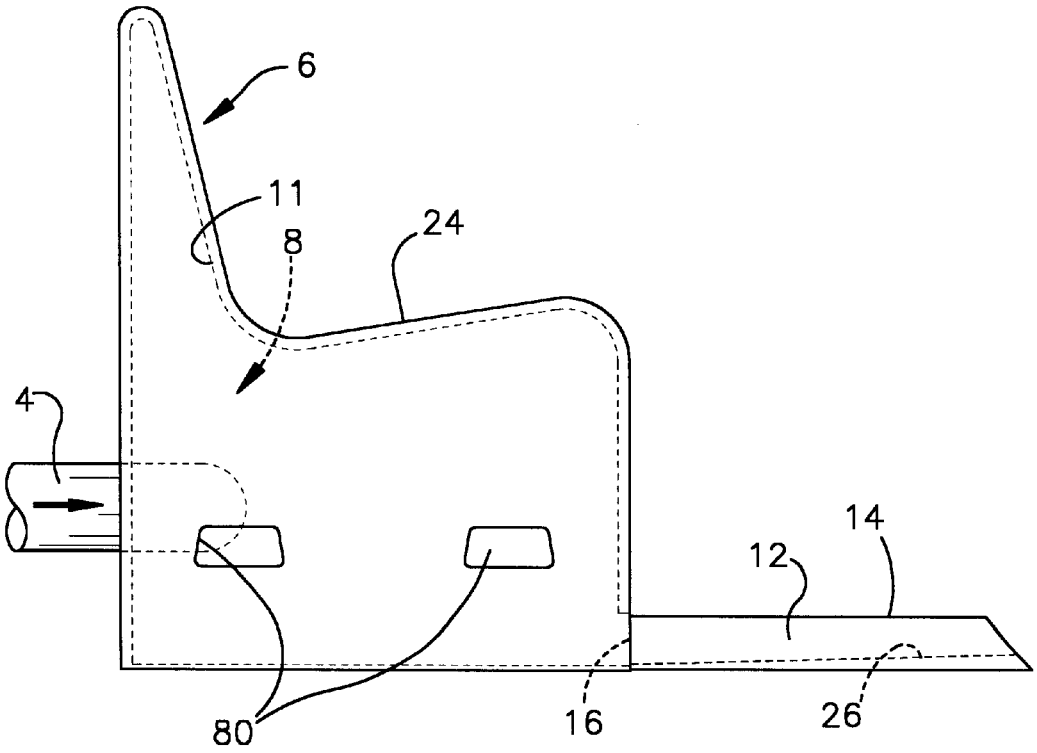
FIG. 1E is a side view of the invention, illustrated with the deck extending from the base of the footwall of the bench.
Figure 2:
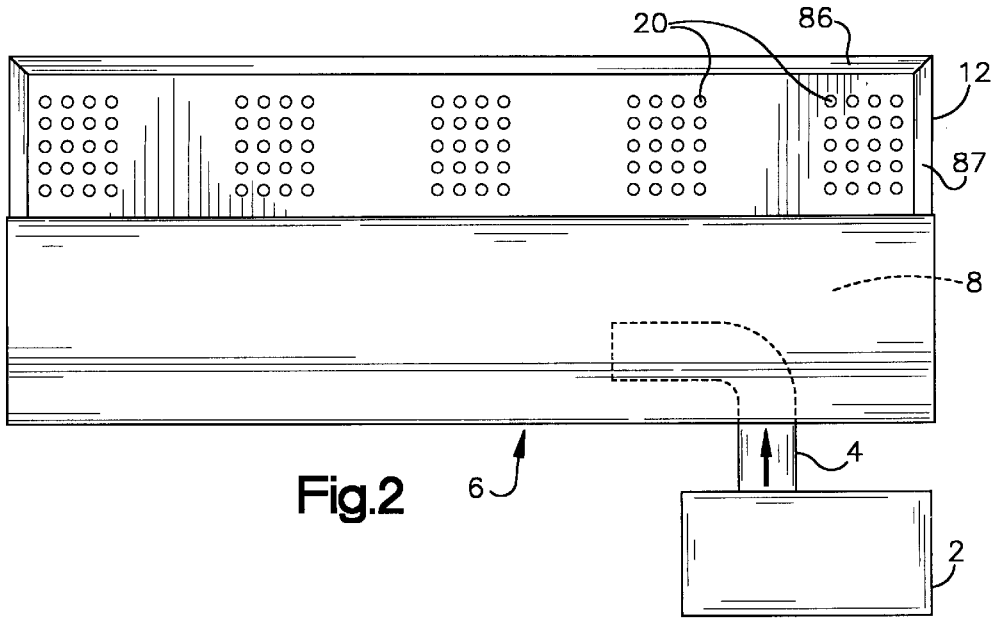
FIG. 2 is a top view of the invention illustrated with the deck extending from the base of the footwall of the bench.
Figure 3:
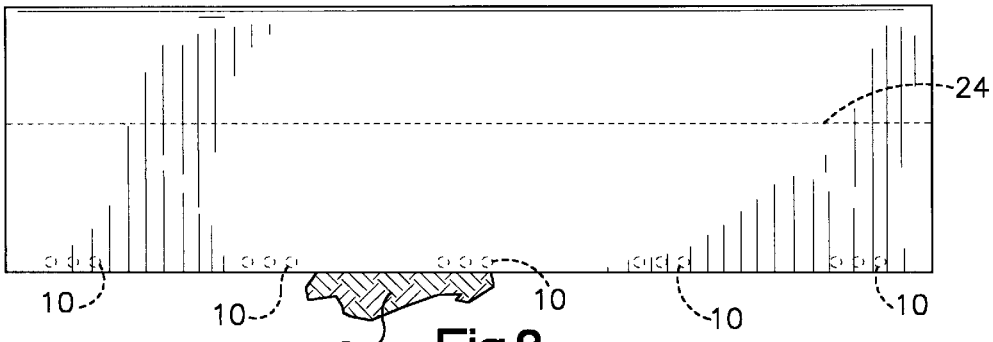
FIG. 3 is a backview of the invention.
Figure 7:
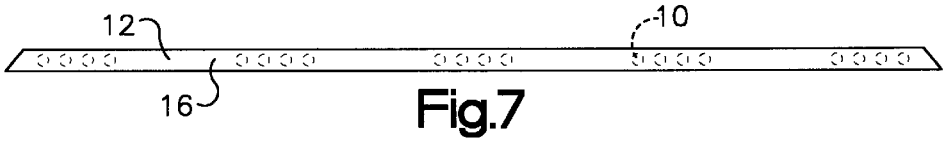
FIG. 7 is a back view of an embodiment of the deck portion of the invention.
Figure 8:
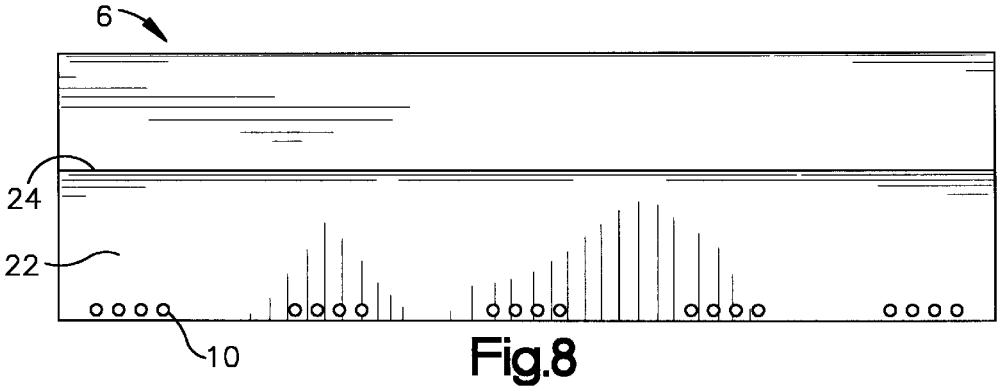
FIG. 8 is a front view of a first embodiment of the bench portion of the invention is a front view of a second embodiment of the bench portion of the invention.
Figure 9:
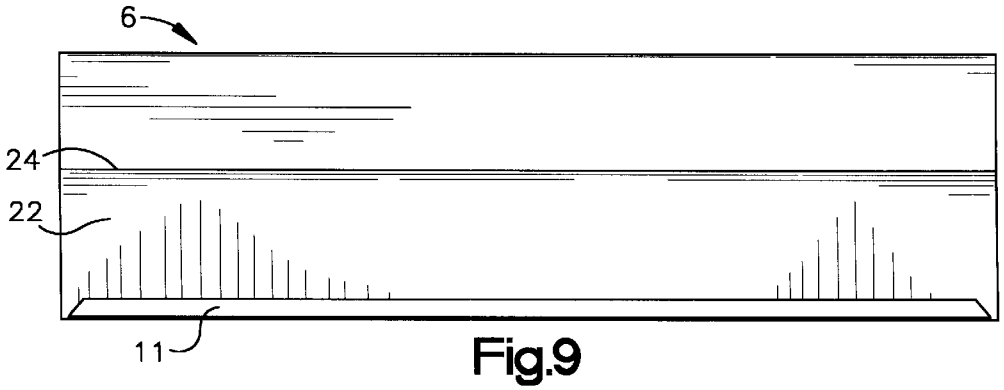

The heated pressurized air forced into the interior space 8 of the bench must be exhausted out of the warming system. This exhaustion is accomplished through perforations 10 in either the footwall 22, as shown in FIG. 8, or the back wall 16 of the deck, as shown in FIG. 7. The structure in which the perforations 10 are located depends upon the particular embodiment of the invention. Regardless of the structure in which the perforations 10 are technically located, when the invention is in operation, the perforations 10 will be, as illustrated, in an otherwise continuous wall that runs from the base of the bench to the seating surface 24 and that occupies the same plane as the footwall 22. This continuous wall is referred to hereinafter as the frontal wall 28. FIG. 1E illustrates the frontal wall 28. FIG. 8 illustrates how the frontal wall 28 could be comprised entirely of the footwall 22. FIGS. 7 and 9 illustrate the bench 6 and deck 12 structures that might be combined to form the frontal wall 28 as depicted in FIG. 1.

Figure 4:
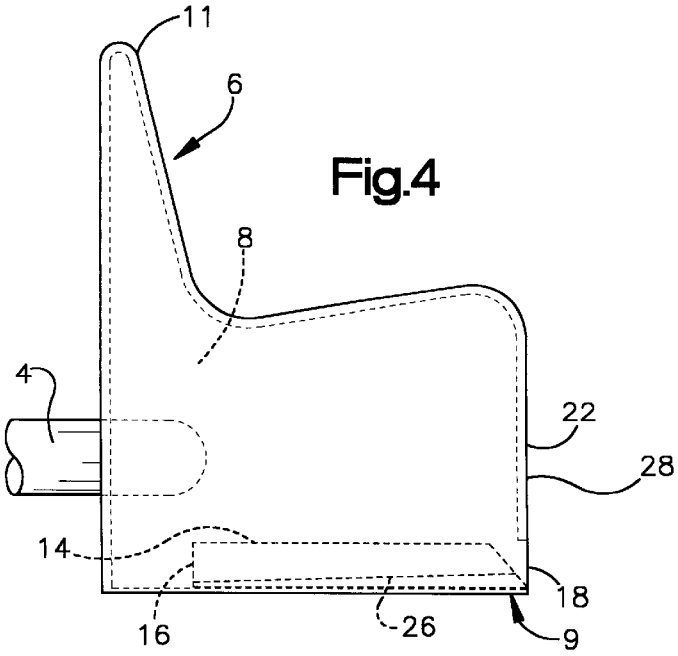
FIG. 4 is a side view of a first embodiment of the invention, illustrated with a retractile deck in the closed position.
Figure 5:
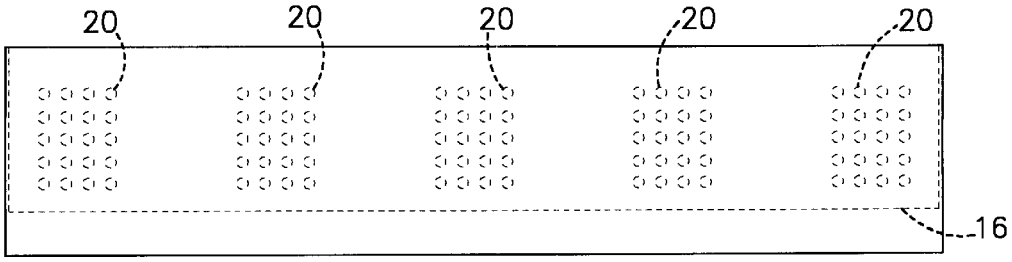
FIG. 5 is a top view of a second embodiment of the invention, illustrated with a retractile deck in the closed position.
Figure 6:
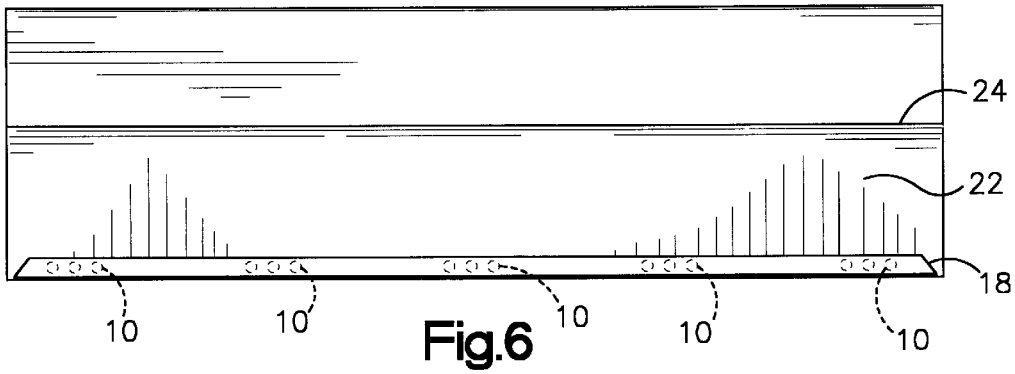
FIG. 6 is a front view of the invention. All embodiments of the invention in its operable form will substantially share this basic appearance.

The heated, pressurized air is exhausted through the perforations 10 in the base of the frontal wall 28 and into a substantially hollow deck 12. The deck is designed to extend outwardly from the footwall 22 of the bench. The deck has perforations 20 in its top surface 14 through which the heated pressurized air is exhausted from the deck and from the inventive seating device entirely. The deck may be a separate component from the bench, or it may be part of a unibody construction with the bench. It is preferred that that the deck 12 be a separate component which is retractable within the interior space 8 of the bench. FIGS. 4 and 5 illustrate this preferred embodiment of the invention in its closed or retracted position. In the retracted position, the front wall 18 of the deck is flush with and forms a continuous frontal wall 28 (free of perforations) with the footwall 22. In the extended or operable position of the preferred embodiment of the invention, the back wall 16 of the deck is flush and forms a continuous frontal wall 28 with the footwall 22, except for the perforations 10. The perforations 10 are located at the base of the frontal wall 28, the base of the frontal wall being comprised of the back wall 16 of the deck.

It is preferred that the deck 12 have a sloped interior floor 26 so that water condensing in or running into the deck can be drained away from the interior of the deck. Additionally, in the embodiment of deck 6 illustrated in FIGS. 1A–1D, includes a top surface 14 having a plurality of perforations 20. Heated pressurized air is exhausted from the deck via the perforations. Front and side edge portions 86, 87 respectively, extend from the top surface 14 to the ground G. The front and side edge portions 86, 87 are sloped to provide effective drainage and avoid having the deck become a trip hazard. It is also preferred that the retractable deck 12 be entirely removable from the bench 6 so that the interiors of both the bench and the deck are accessible for cleaning. Handles 80 can be used to lift and transport the bench 6.

Although the bench and deck may be constructed from any suitably strong and conductive material, it is preferred that bench and deck be formed from injection molded fiberglass. It is also preferred that the inventive personnel warming system be capable of supporting a total load of 2000 pounds, the load comprising the total weight of any combination of persons sitting or standing on the device.

What is claimed is:

1. A seating device comprising:

a source of heated air;

a bench fluidly connected to the source of heated air, and having a frontal wall, a deck, and defining an interior space into which heated air from the source of heated air is received, the frontal wall having perforations through which heated air is exhausted to the deck;

the deck defining an interior space into which heated air is received, the deck extending from the frontal wall of the bench and having a top surface; and the top surface of the deck having a plurality of perforations through which the heated air is exhausted.

2. The device of claim 1 wherein the bench and the deck are comprised of injection-molded fiberglass.

3. The device of claim 1 wherein the device is capable of supporting a load in of 2000 pounds.

4. The device of claim 1 wherein the deck further includes an interior floor portion which is sloped.

5. The device of claim 1 wherein the source of heated air is a forced air heater for supplying air to the bench.

6. The device of claim 1 wherein the bench and the deck comprise a continuous, unitary construction.

7. The device of claim 1 wherein the bench and the deck are separate structures capable of being repeatedly attached and detached.

8. The device of claim 1 wherein the deck includes a top surface for supporting users of the heating device, and the top surface includes front and side surface edge portions which are sloped in a direction away from the top surface.

9. A personnel warming device comprising:

a source of heated pressurized air;

a substantially hollow bench having a footwall, the bench fluidly connected to the source of heated pressurized air at an opening, and further defining an interior space into which the heated pressurized air is received via the opening, the bench also having a substantially hollow deck extending outwardly from the footwall of the bench;

the deck having a top surface, a back wall and a front wall, the front wall having a flush surface for engagement with the footwall portion of the bench when the deck is in the retracted or closed position, and a back wall with a flush surface for engagement with the footwall portion of the bench when the deck is in the extended or open position, the back wall of the deck having a plurality of perforations through which the heated pressurized air is exhausted from the interior space of the bench into the deck when the deck is in its extended position, and the top surface of the deck having a plurality of perforations through which heated pressurized air is exhausted from the device.

10. The device of claim 9 wherein the bench and the deck are comprised of injection-molded fiberglass.

11. The device of claim 9 wherein the device is capable of supporting a load of 2000 pounds.

12. The device of claim 9 wherein the deck further includes an interior floor portion which is sloped.

13. The device of claim 9 wherein the deck may be removed from engagement with the bench.

14. The device of claim 9 wherein the deck includes a top surface for supporting users of the heating device, and the top surface includes front and side surface edge portions which are sloped in a direction away from the top surface.

* * * * *